US006709089B2

(12) United States Patent
Koeda

(10) Patent No.: US 6,709,089 B2
(45) Date of Patent: Mar. 23, 2004

(54) INK-JET HEAD, METHOD OF MANUFACTURE THEREOF, AND INK-JET PRINTER

(75) Inventor: Hiroshi Koeda, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/135,062

(22) Filed: Apr. 29, 2002

(65) Prior Publication Data

US 2002/0130925 A1 Sep. 19, 2002

Related U.S. Application Data

(63) Continuation of application No. 09/367,926, filed as application No. PCT/JP99/00025 on Jan. 8, 1999.

(30) Foreign Application Priority Data

Jan. 9, 1998 (JP) ..... 10-003548

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS

| | | | |
|---|---|---|---|
| 5,311,360 | A | 5/1994 | Bloom et al. |
| 5,322,594 | A | 6/1994 | Bol |
| 5,459,501 | A | 10/1995 | Lee et al. |
| 5,459,610 | A | 10/1995 | Bloom et al. |
| 5,491,500 | A | 2/1996 | Inui et al. |
| 5,581,861 | A | 12/1996 | Lee et al. |
| 5,666,141 | A | 9/1997 | Matoba et al. |
| 5,668,579 | A | 9/1997 | Fujii et al. |
| 5,828,394 | A | 10/1998 | Khuri-Yakub et al. |
| 5,984,458 | A | 11/1999 | Murai |
| 6,113,218 | A | 9/2000 | Atobe et al. |
| 6,213,590 | B1 * | 4/2001 | Fujii et al. |

FOREIGN PATENT DOCUMENTS

| | | |
|---|---|---|
| JP | 6071882 | 3/1994 |
| JP | 7177761 | 7/1995 |
| JP | 9081924 | 3/1997 |
| JP | 9113534 | 5/1997 |
| JP | 9254381 | 9/1997 |
| JP | 9272204 | 10/1997 |
| WO | 9641217 | 12/1996 |

OTHER PUBLICATIONS

English Abstract of JP 09254381.
English Abstract of JP 09272204.
English Abstract of JP 06071882.
English Abstract of JP 07177761.
English Abstract of JP 09081924.
English Abstract of JP 09113534.
Patent Abstract of Japan of JP 09–254381, dated Sep. 30, 1997.
Patent Abstract of Japan of JP 09–272204, dated Oct. 21, 1997.

* cited by examiner

*Primary Examiner*—Raquel Yvette Gordon
(74) *Attorney, Agent, or Firm*—Ladas & Parry

(57) ABSTRACT

An ink-jet head, a manufacturing method thereof, and an ink-jet recording apparatus, in which a substrate low in price, easy to handle and large in size can be used to thereby improve the productivity. Individual electrodes (101) are formed on an electrode glass substrate (100), and covered with an insulating film (202). A sacrificial layer (110) is formed on the insulating film (202), and diaphragms (201) are formed thereon. Window portions (212) are provided in support portions of the diaphragms (201). The sacrificial layer (110) is etched through the window portions (212) to thereby form an electrostatic actuator structure. After that, to close the window portions (212), Ni is deposited all over the surface again, and thereafter the Ni film is patterned to thereby form partition base portions (213). Cavity partitions (214) are formed by Ni electrocasting, and a nozzle plate (300) is bonded therewith.

1 Claim, 7 Drawing Sheets

INK-JET HEAD, METHOD OF MANUFACTURE THEREOF, AND INK-JET PRINTER

This application is a continuation of application Ser. No. 09/367,926 filed on Aug. 20, 1999, which is International Application PCT/JP99/00025 filed on Jan. 8, 1999, which designated the U.S., claims the benefit thereof and incorporates the same by reference.

TECHNICAL FIELD

The present invention relates to an ink-jet head for ejecting ink drops to paper or the like to perform printing, a method of manufacturing the same, and an ink-jet recording apparatus on which the ink-jet head is mounted.

BACKGROUND ART

Recently, a very small actuator has been demanded for use in an ink-jet recording apparatus for the purpose of high-speed and high-precision printing with the development of a multi-nozzle structure and for the purpose of miniaturization of the apparatus. To this end, there is an ink-jet recording apparatus using static electricity for an actuator (for example, JP-A-6-71882). The ink-jet head is characterized in that an electrostatic actuator is formed of parallel plate electrodes, so that the actuator can be miniaturized and a multi-nozzle structure can be realized.

FIGS. 10 and 11 are a sectional view and a plan view, respectively, of a conventional ink-jet head driven by an electrostatic actuator. The ink-jet head shown in FIG. 10 and FIG. 11 has a lamination structure in which an electrode glass substrate 100, a diaphragm substrate 200, and a nozzle plate 300 are laid on the top of one another and bonded with each other. An ink supply port 104 is formed in the electrode glass substrate 100, and ink 400 is supplied from the ink supply port 104 to a reservoir 204 formed in the diaphragm substrate 200. The ink 400 is equally distributed to a plurality of cavities 203 through orifices 302 defined by the nozzle plate 300 and recess portions of the diaphragm substrate 200. The lower surface of each of the cavities 203 is constituted by a transformable diaphragm 201. This diaphragm 201 faces an individual electrode 101 through an air gap and an insulating film 200 for preventing short-circuit so as to constitute an electrostatic actuator. A common electrode 205 is disposed on the diaphragm substrate 200. An voltage is applied between the diaphragm 201 and the individual electrode 101 through this common electrode 205, so that an electrostatic attractive force is generated to transform the diaphragm 201 downward. After that, an ink drop 401 is ejected from a nozzle 301 by the pressure due to the spring force of the diaphragm 201 which is generated when the applied voltage is removed.

In the above-mentioned electrostatically driven ink-jet head, it is regarded as being preferable, from the point of practical view, to drive the electrostatic actuator by a driving voltage of 100 V or less. In order to drive the electrostatic actuator by a driving voltage of 100 V or less, the distance between the insulating film 202 of the electrostatic actuator and the individual electrode 101 is formed accurately to be in a range of from 2,000 to 3,000 angstroms. To this end, a diaphragm substrate constituted by a silicon single-crystal substrate having a bonded surface mirror-finished with high precision was required to be bonded, by anode-bonding, directly with an electrode glass substrate constituted by a borosilicate glass substrate and provided with a step by etching. In this case, however, there is a problem that such a silicon substrate mirror-finished with high precision is expensive and hard to obtain. In addition, in order to obtain required strength, it is necessary to use a thin silicon single-crystal substrate and reduce the height of partitions between respective cavities because the thickness of the partitions are reduced in accordance with the high density of nozzles. However, it is extremely difficult to handle such a thin silicon single-crystal substrate, and particularly there is another problem that it is difficult to increase the size of the substrate.

By the way, there is a method in which etching of a sacrificial layer is used to produce such a narrow gap as described above. For example, a method in which a sacrificial layer is. formed and then the sacrificial layer is removed by etching so as to form air gaps is proposed in JP-A-10-510374, page 8 and U.S. Pat. No. 54,596, in FIG. 2. However, all the air gaps are provided for electrostatically modulating positions of the reflecting surface of a light valve. In addition, all the air gaps are made open, unlike closed air gaps formed between insulating film and individual electrodes of an electrostatic actuator of an ink-jet head. It is therefore impossible to apply the technique disclosed in the above-mentioned publications or the like as it is to the manufacturing of an ink-jet head.

DISCLOSURE OF THE INVENTION

It is an object of the present invention to provide an ink-jet head and a manufacturing method thereof, in which a substrate low in cost, easy to handle and large in size can be used to improve the productivity.

It is another object of the present invention to provide an ink-jet recording apparatus mounted with an ink-jet head manufactured by the above-mentioned manufacturing method.

(1) One aspect of the present invention is an ink jet head comprising a plurality of nozzle holes, ejection chambers independent of each other and communicating with the nozzle holes respectively, electrically conductive diaphragms constituting parts of the respective ejection chambers, and individual electrodes facing the diaphragms through air gaps respectively, and ejecting ink in the ejection chambers toward recording paper through the respective nozzle holes by applying voltages between the diaphragms and the individual electrodes to thereby transform the diaphragms, wherein the air gaps are formed by sacrificial layer etching. In the present invention, since the air gaps are formed by sacrificial layer etching, the air gaps can be formed with high precision, for example, in a range of from 2,000 to 3,000 angstroms, so that it is possible to drive the ink-jet head by a driving voltage of 100 V or less. In addition, it is not necessary to use a silicon single-crystal substrate, so that the substrate can be made layer in size. Therefore, the ink-jet head can be suitably adapted for a line printer or the like having a multi-nozzle.

(2) Another aspect of the present invention is a method of manufacturing an ink-jet head comprising a plurality of nozzle holes, ejection chambers independent of each other and communicating with the nozzle holes respectively, electrically conductive diaphragms constituting parts of the respective ejection chambers, and individual electrodes facing the diaphragms through air gaps respectively, and ejecting ink in the ejection chambers toward recording paper through the respective nozzle holes by applying voltages between the diaphragms and the individual electrodes to thereby transform the diaphragms, wherein the air gaps are formed by sacrificial layer etching. In the present invention, since a sacrificial layer can be formed in a thin film process such as vapor deposition, CVD, or the like, a silicon single-crystal substrate mirror-finished with high precision is not required and electrostatic actuators can be formed only in such a thin film process. It is therefore possible to use a large-sized glass substrate, and thereby improve the productivity.

(3) A further aspect of the present invention is a method of manufacturing an ink-jet head based on the above-mentioned manufacturing method (2), wherein the individual electrodes are formed on a substrate; an insulating film, a sacrificial layer and a diaphragm layer are subsequently formed so as to cover the individual electrodes; and window portions are formed in the diaphragm layer in part of predetermined positions where support portions of the diaphragms are to be located to perform the sacrificial layer etching through the window portions. Since the window portions are formed at places corresponding to the support portions of the diaphragms in such a manner and no aperture portion is formed in the diaphragms themselves, there is no deterioration in the properties of the diaphragms. In addition, it will go well if etching liquid permeates the sacrificial layer in its short-side direction through the window portions. Therefore, there is an advantage that it is easy for the etching liquid to permeate the sacrificial layer. The insulating layer, the sacrificial layer and the diaphragm layer may be formed in the order of the insulating layer, the sacrificial layer and the diaphragm layer, or in the order of the sacrificial layer, the insulating layer and the diaphragm layer.

(4) A still further aspect of the present invention is a method of manufacturing an ink-jet head based on the above-mentioned manufacturing method (3), wherein slit portions are formed in the sacrificial layer and the diaphragm layer in positions where the window portions in the predetermined positions are not formed. Since the support portions are formed in the slit portions as they are, the support portions become so firm that the diaphragms can be supported stably.

(5) Another aspect of the present invention is a method of manufacturing an ink-jet head based on the above-mentioned manufacturing method (3), wherein a plurality of window portions are dispersively formed for each of the air gaps. Since the window portions are dispersively formed, the sacrificial layer etching is performed uniformly. In addition, although the portions where the window portions are located are weak and apt to lift in the manufacturing process, the strength is increased by dispersively forming the window portions, so that the ink-jet head can be manufactured easily.

(6) A further aspect of the present invention is a method of manufacturing an ink-jet head based on the above-mentioned manufacturing method (2), wherein the window portions are closed to form cavity partitions after the sacrificial layer etching. As a result, it is possible to obtain a closed structure efficiently, and it is possible to prevent ink from soaking into the electrostatic actuators.

(7) A still further aspect of the present invention is a method of manufacturing an ink-jet head based on the above-mentioned manufacturing method (2), wherein the diaphragms are formed of a laminated film constituted by a conductive film and a film having a tensile force. which is a film-forming stress. It is therefore possible to prevent the diaphragms from sagging. It is possible to prevent the diaphragms from touching the lower layer (individual electrodes) when the sacrificial layer etching is finished.

(8) Another aspect of the present invention is a method of manufacturing an ink-jet head based on the above-mentioned manufacturing method (7), wherein the diaphragms are formed by laminating, for example, an Ni layer and a silicon nitride layer on each other. The diaphragms come in contact with the electrodes when the electrostatic actuators are driven. However, there is no fear of abrasion since it is the Ni layer with high hardness that comes in contact with the electrodes. In addition, the silicon nitride layer has enough tension so as not to produce sagging in the diaphragms.

(9) A further aspect of the present invention is a method of manufacturing an ink-jet head based on the above-mentioned manufacturing method (2), wherein the diaphragms are formed of a conductive film having a tensile force which is a film-forming stress. It is therefore possible to prevent the diaphragms from sagging even if the diaphragms are of a single layer. It is possible to prevent the diaphragms from touching the lower layer (individual electrodes) when the sacrificial layer etching is finished.

(10) A still further aspect of the present invention is a method of manufacturing an ink-jet head based on the above-mentioned manufacturing method (9), wherein the diaphragms are formed by depositing, for example, Pt. Since the diaphragms can be formed of a single layer which is a Pt layer with high hardness and high tension, it is possible to simplify the manufacturing process.

(11) Another aspect of the present invention is a method of manufacturing an ink-jet head based on the above-mentioned manufacturing method (2), wherein the sacrificial layer is formed of an organic film, and the sacrificial layer etching is performed by dry etching. By the dry etching, the management of the manufacturing becomes not difficult, unlike wet etching, so that it is possible to simplify the process.

(12) A further aspect of the present invention is a method of manufacturing an ink-jet head based on the above-mentioned manufacturing method (2), wherein the independent electrodes are formed on an electrode glass substrate; the independent electrodes are covered with an insulating film; a sacrificial layer is formed on the insulating film; a diaphragm layer is formed on the sacrificial layer; window portions are formed in the diaphragm layer in predetermined positions where support portions of the diaphragms are to be located between the individual electrodes; the sacrificial layer is etched through the window portions to thereby form an electrostatic actuator structure; Ni is subsequently deposited all over the surface and thereafter patterned to thereby form partition base portions to close the window portions; cavity partitions are formed on the partition base portions by Ni electrocasting; and then a nozzle plate is bonded on the cavity partitions. In the present invention, since the sacrificial layer can be formed in a thin film process such as vapor deposition, CVD, or the like, a silicon single-crystal substrate mirror-finished with high precision is not required, and electrostatic actuators can be formed only in such a thin film process. It is therefore possible to use a large-sized glass substrate and thereby improve the productivity. Further, it is possible to obtain a closed structure efficiently, and there is such an advantage that it is possible to prevent ink from soaking into the electrostatic actuators, etc.

(13) A still further aspect of the present invention is an ink-jet recording apparatus equipped with an ink-jet manufactured by any one of the above-mentioned ink-jet head manufacturing methods (2) to (12). Since the ink-jet head manufactured by any one of the ink-jet head manufacturing methods (2) to (12) has no limitation in the material of a substrate, a glass substrate may be used. It is therefore possible to use a large-sized glass substrate, so that it is possible to manufacture a high-performance printer at a low price.

(14) Another aspect of the present invention is an ink-jet recording apparatus equipped with an ink-jet head for a line printer manufactured by any one of the above-mentioned ink-jet head manufacturing methods (2) to (12). Since the ink-jet head manufactured by any one of the ink-jet head manufacturing methods (2) to (12) has no limitation in the material of a substrate, a glass substrate may be used. It is therefore possible to use a large-size glass substrate, so that it is possible to form a multi-nozzle. As a result, it is possible to manufacture a line printer at a low price.

(15) A further aspect of the present invention is an ink-jet head comprising a plurality of nozzle holes, ejection chambers independent of each other and communicating with the nozzle holes respectively, electrically conductive diaphragms constituting parts of the respective ejection chambers, and individual electrodes facing the diaphragms through air gaps respectively, and ejecting ink in the ejection chambers toward recording paper through the respective nozzle holes by applying voltages between the diaphragms and the individual electrodes to thereby transform the diaphragms, wherein an insulating film is formed on the individual electrodes.

THE BEST MODE FOR CARRYING-OUT THE INVENTION

Embodiment 1

Figure 1:
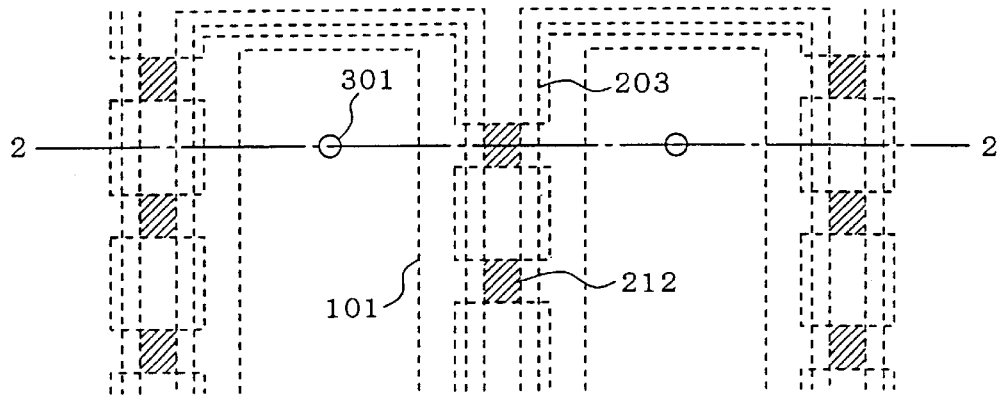
FIG. 1 is a plan view of an ink-jet head manufactured by a manufacturing method according to Embodiment 1 of the present invention.
Figure 2:
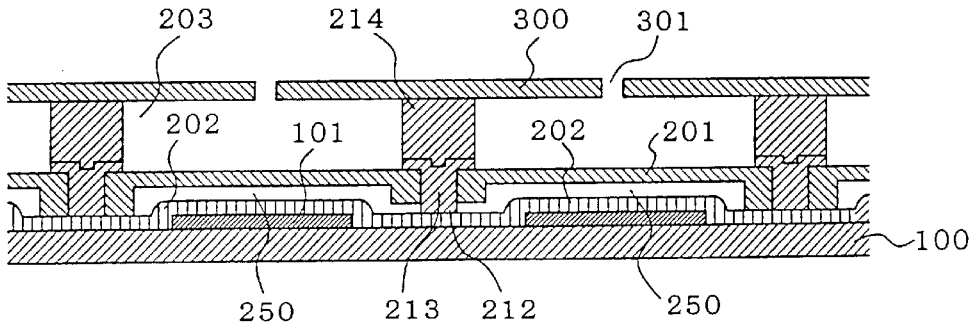
FIG. 2 is a sectional view of the ink-jet head taken on line 2—2 in FIG. 1.
Figure 10:
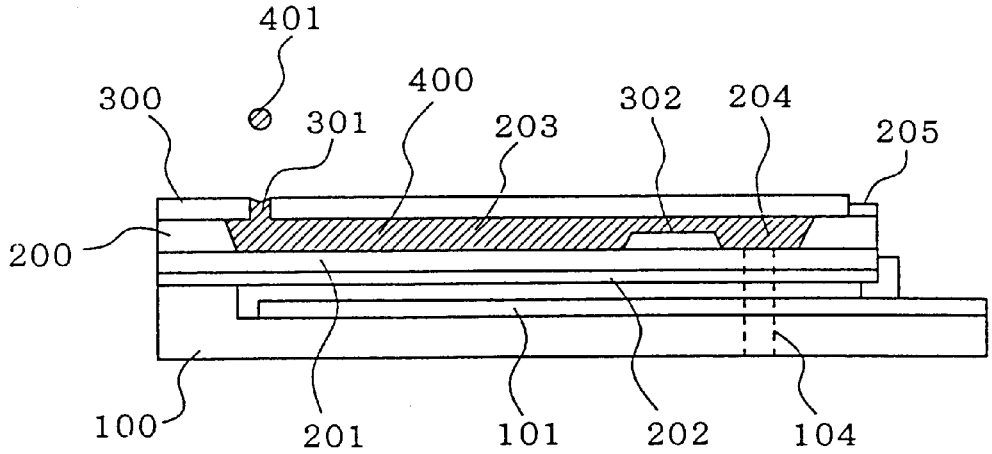
FIG. 10 is a plan view of an ink-jet head driven by a conventional electrostatic actuator.
Figure 11:
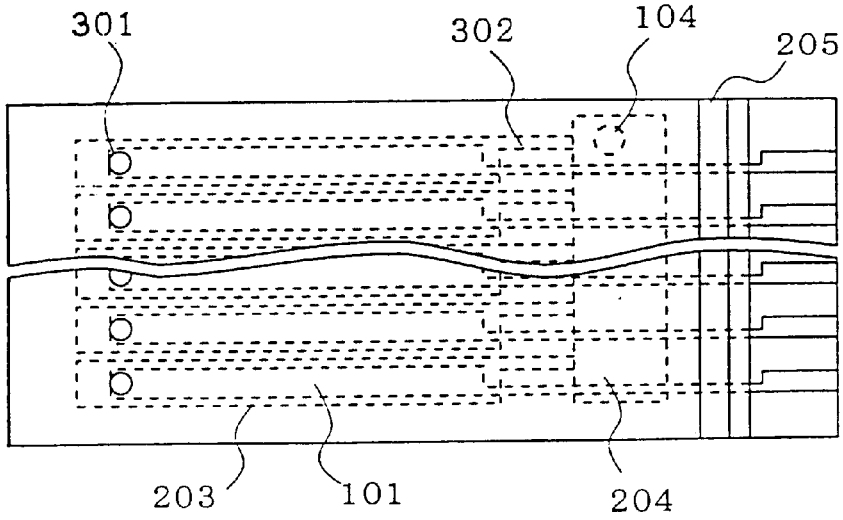
FIG. 11 is a sectional view of the ink-jet head driven by the conventional electrostatic actuator.

FIG. 1 is a plan view of an ink-jet head manufactured by a manufacturing method according to Embodiment 1 of the present invention, and FIG. 2 is a sectional view of the same ink-jet head taken on line 2—2. This ink-jet head has a basic structure substantially the same as that of the ink-jet head shown in FIGS. 10 and 11. Therefore, the structure will be described below while paying attention to portions directly concerned with the present invention. This ink-jet head has an electrode glass substrate 100, individual electrodes 101 disposed on this electrode glass substrate 100 and covered with an insulating film 202 of silicon dioxide, diaphragms 201 facing the individual electrodes 101 through air gaps 250 respectively, ink cavities 203, cavity partition base portions 213, cavity partitions 214, and a nozzle plate 300. Although window portions 212 for sacrificial layer etching are shown in FIG. 1, these window portions 212 are formed in the manufacturing process but they are not present after manufacturing. Accordingly, the window portions 212 in FIG. 1 are illustrated merely to indicate their positions which are located at predetermined intervals in the longitudinal direction of the cavity partition base portions 213 and the cavity partitions 214.

Figure 3:
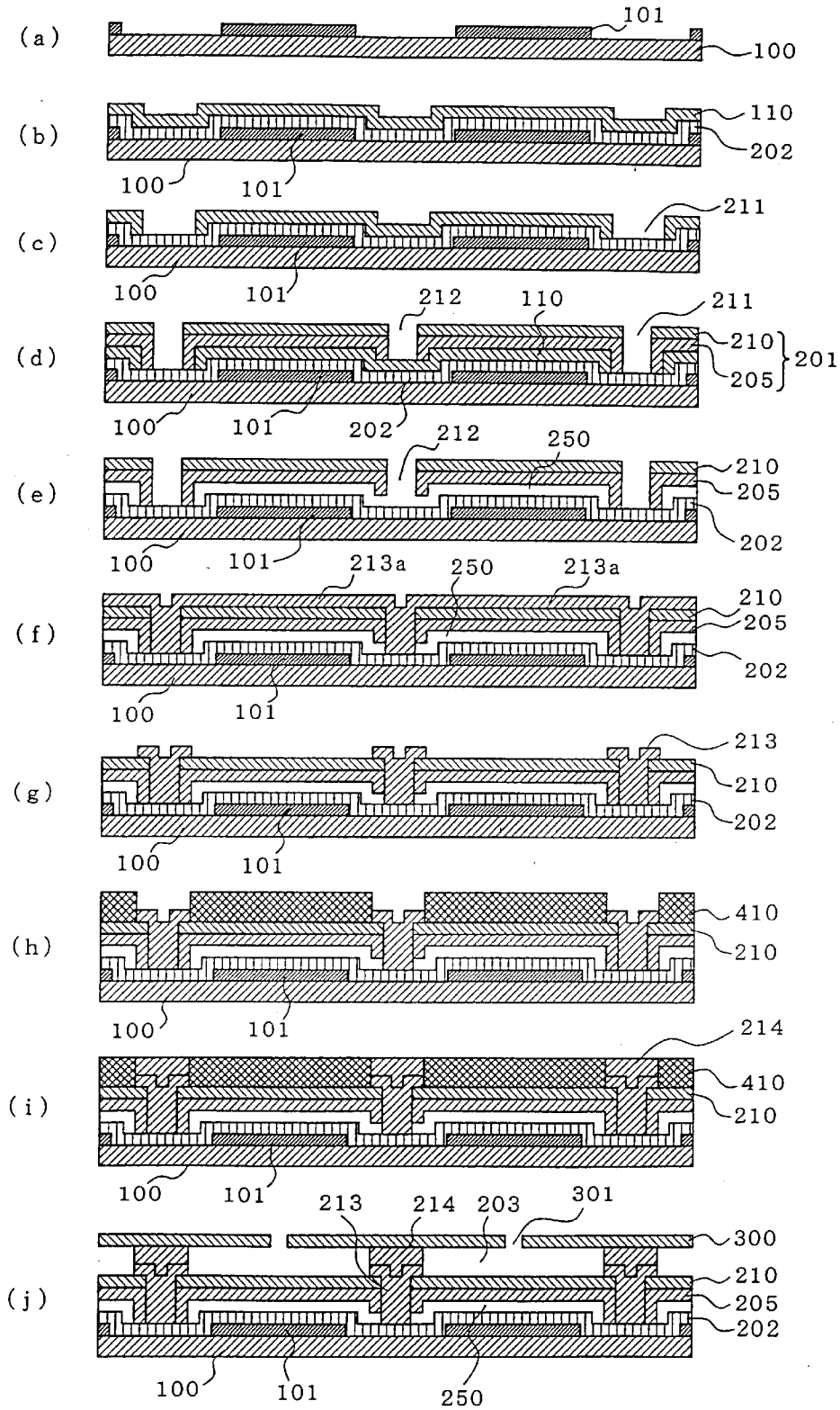
FIG. 3 is a manufacturing process diagram of the ink-jet head according to Embodiment 1 of the present invention.

FIG. 3 is a diagram showing a manufacturing process of the ink-jet head shown in FIGS. 1 and 2.

(a) First, Cr and Au are deposited to a thickness of 50 angstroms and a thickness of 1,000 angstroms, respectively, on the electrode glass substrate 100 by sputtering, and Cr and Au are then patterned by photolithography to thereby form the individual electrodes 101.

(b) Next, silicon dioxide is deposited to a thickness of 1,000 angstroms by CVD so as to form the insulating film 202 which covers the individual electrodes 101. Thereafter, Al is vapor-deposited to a thickness of 2,000 angstroms on the insulating film 202 so as to form the sacrificial layer 110.

(C) Here, slits 211 are provided in the sacrificial layer 110 so as to be located between the individual electrodes 101. With these slits 211, in the step which will be described later, one of the widthwise end portions of each diaphragm 201 can be formed directly on the electrode glass substrate 100 so as to form a support portion of the diaphragm 201. The above-mentioned process is not given to positions corresponding to the window portions 212 for sacrificial layer etching (see FIG. 1) so that the slits 211 are not formed there.

(d) Next, Ni which will form a common electrode 205 of the electrostatic actuators is sputtered to a thickness of 1,000 angstroms on the sacrificial layer 110. After that, a silicon nitride film 210 is deposited to a thickness of 7,000 angstroms by CVD so as to produce the diaphragms 201 constituted by the common electrode 205 and the silicon nitride film 210. At this time, the end portions (on the side where the slits 211 are provided) of the diaphragms 201 are formed directly on the electrode glass substrate 100 so as to cover the sacrificial layer 110. After the diaphragms 201 are produced, the silicon nitride film 210 and the Ni film (common electrode) 205 are etched corresponding to the slit portions 211 and the window portions 212 for sacrificial layer etching. Here, the reason why the silicon nitride film 210 is used is to prevent the diaphragms 201 from sagging by using the fact that the tensile force of the silicon nitride film is its film-forming stress.

(e) After the window portions 212 are opened, an aqueous solution of 32% HCl and 30% hydrogen peroxide is circulated from these window portions 212 at room temperature so as to etch the Al sacrificial layer 110. Here, if transparent electrode material such as ITO is used for the individual electrodes 101 instead of Cr/Au, the conditions of etching the sacrificial layer 110 can be observed. In the stage where this sacrificial layer etching has been finished, air gaps 250 formed by the sacrificial layer etching are made to communicate with the outside only through the window portions 212.

(f) After the sacrificial layer etching, Ni is again deposited all over the surface to a thickness of 3,000 angstroms in order to close the window portions 212, and a Ni film 213*a* is formed. The air gaps 250 are closed in this step.

(g) After the Ni film is formed, the partition base portions 213 are formed by patterning. The air gaps 250 are enclosed in this process. That is, each air gap 250 is enclosed with the corresponding partition base portion 213 at the window portion 212 and with the corresponding diaphragm 201 over the rest portion. Therefore, each air gap 250 is closed out.

(h) Next, resist 410 is applied to a thickness of 100 microns. After that, the resist 410 is cut out like slits perpendicularly to reach the partition base portions 213 by anisotropic dry etching.

Figure 4:
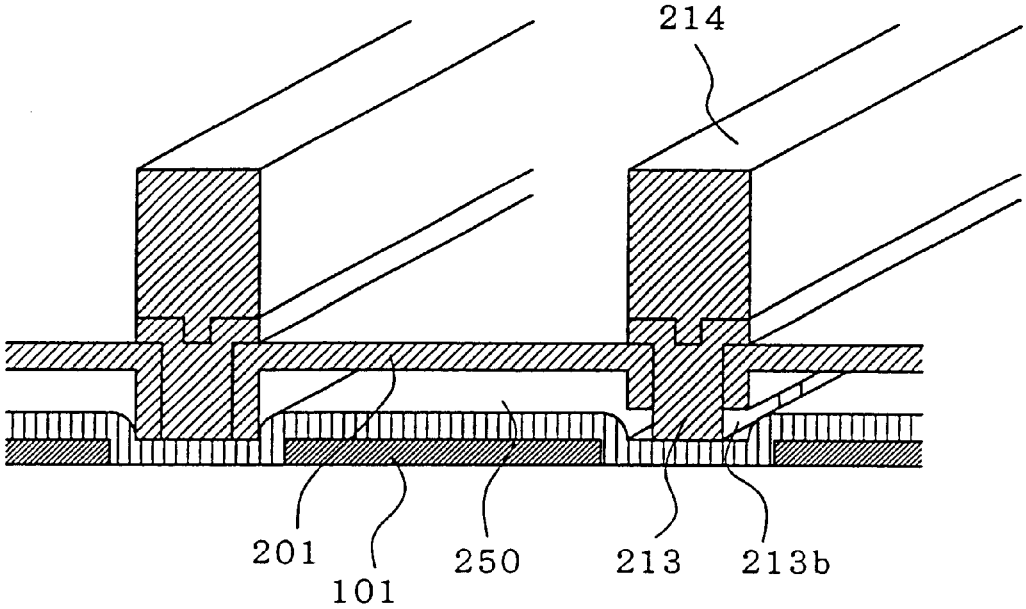
FIG. 4 is a perspective view of the ink-jet head in the manufacturing process of FIG. 3.

(i) The cavity partitions 214 are formed respectively on the partition base portions 213 by Ni electrocasting, and the resist 410 is removed. The conditions at this time are as shown in FIG. 4. The positions corresponding to the window portions 212 are located at predetermined intervals in the longitudinal direction of the diaphragms 201, and formed in such a state that the leading edge portions of the diaphragms 201 are cut out partially.

(j) The nozzle plate 300 of stainless steel in which nozzles 301 are provided is bonded onto the cavity partitions 214 by epoxy resin adhesive so as to form an ink-jet head in FIG. 1 and FIG. 2.

Embodiment 2

Figure 5:
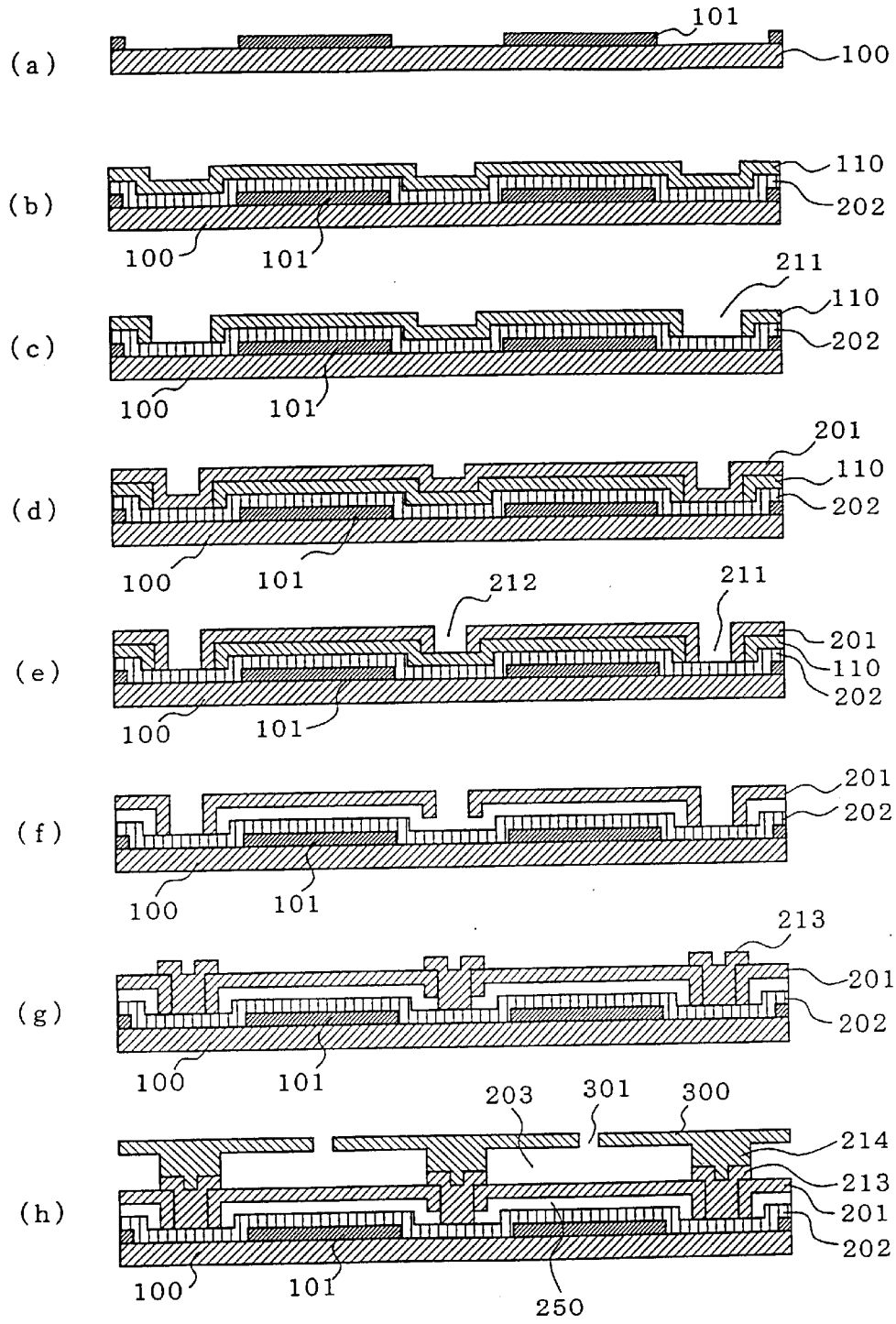
FIG. 5 is a manufacturing process diagram of an ink-jet head according to Embodiment 2 of the present invention.

FIG. 5 is a manufacturing process diagram of an ink-jet head according to Embodiment 2 of the present invention. Embodiment 2 differs from Embodiment 1 in that each diaphragm 201 is constituted by a single layer having electrical conductivity.

(a) to (c) The steps up to forming of a sacrificial layer 110 are the same as those in Embodiment 1 (the same as (a) to (c) of FIG. 3).

(d) After the sacrificial layer 110 is formed, Pt having film-forming stress which is a tensile force is deposited to a thickness of 5,000 angstroms so as to form diaphragms 201.

(e) After Pt is deposited, slit portions 211 and window portions 212 are formed by dry etching with carbon tetrafluoride.

(f) The Al sacrificial layer 110 is etched.

(g) After the Al sacrificial layer 110 is etched and removed, Ni is deposited to a thickness of 3,000 angstroms to close the window portions 212. After that, partition base portions 213 are formed by patterning.

(h) Subsequently, cavity partitions 214 may be formed by Ni electrocasting in the same manner as that in Embodiment 1. However, a nozzle plate 300 constituted by a silicon single-crystal substrate and provided with cavity partitions 214 formed integrally by anisotropic dry etching is bonded to the partition base portions 213 with epoxy resin adhesive, in this Embodiment 2.

Embodiment 3

A manufacturing method in Embodiment 3 of the present invention will be described. In this Embodiment 3, the sacrificial layer 110 in Embodiment 2 is changed from an Al film to an organic film, and removed by oxygen plasma. Since oxygen plasma is used, there appears no sagging in diaphragms 201 due to the surface tension of etching liquid, unlike wet etching. Accordingly, there are no etching leftovers caused by the failure in circulating the etching liquid. In addition, cleansing and drying after etching becomes unnecessary, so that it is possible to simplify the process.

Embodiment 4

Figure 6:
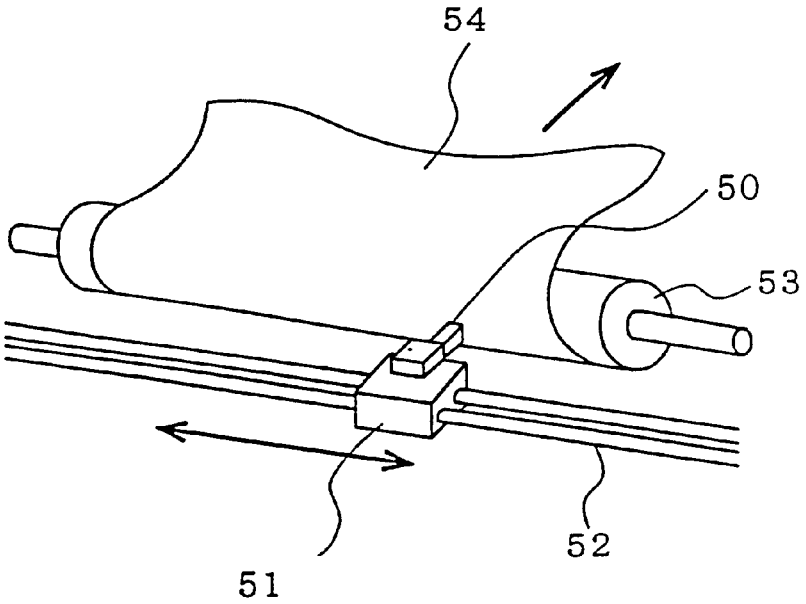
FIG. 6 is an explanatory diagram showing an example of peripheral mechanism of the ink-jet head manufactured through the manufacturing process of FIG. 3 or FIG. 5.
Figure 7:
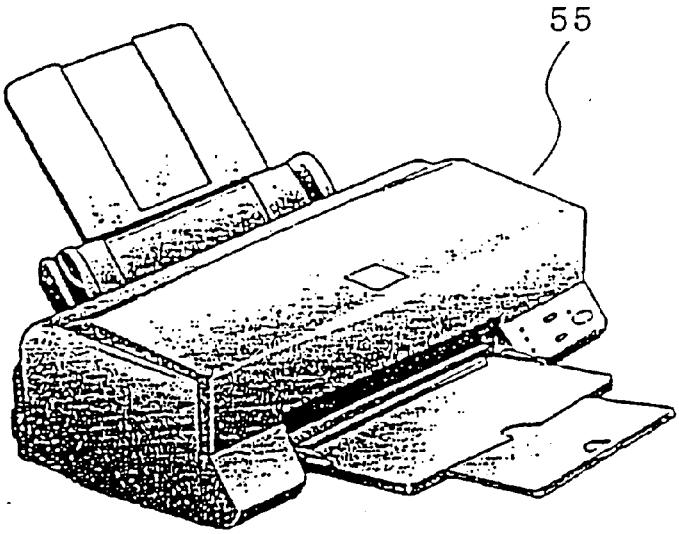
FIG. 7 is an outline view of an ink-jet recording apparatus in which the mechanism of FIG. 6 is incorporated.

FIG. 6 is an explanatory diagram showing an example of a peripheral mechanism of an ink-jet head manufactured in the manufacturing process in any one of Embodiments 1 to 3. This ink-jet head 50 is attached to a carriage 51, and this carriage 51 is attached to guide rails 52 movably. The position of the carriage 51 is controlled in the width direction of paper 54 fed out by a roller 53. This mechanism in FIG. 6 is incorporated in an ink-jet recording apparatus 55 shown in FIG. 7.

Embodiment 5

Figure 8:
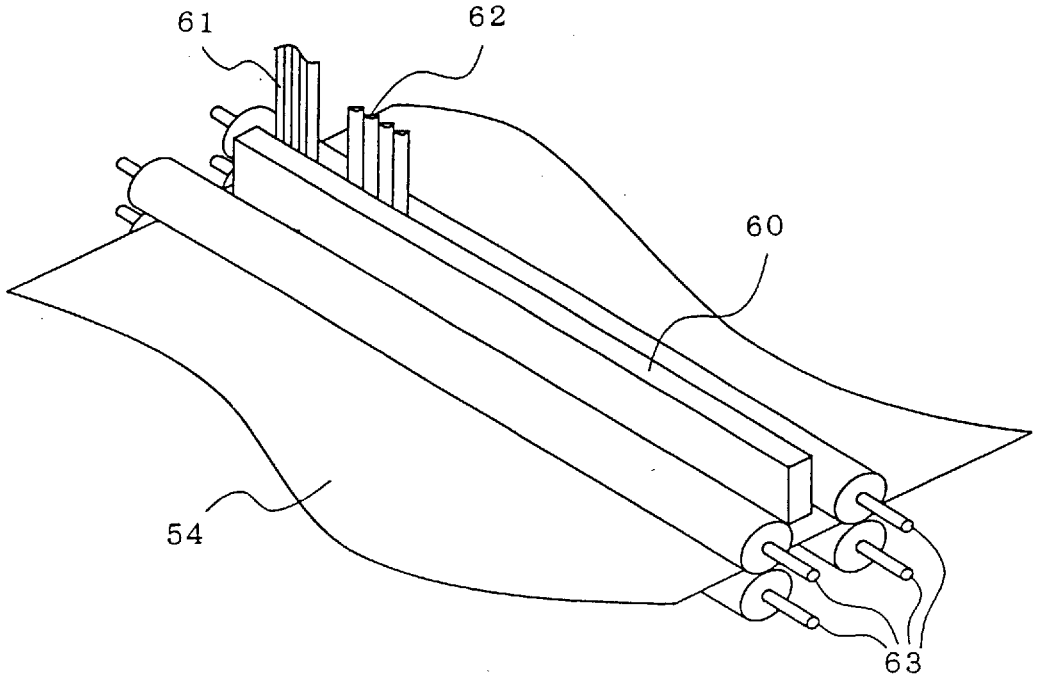
FIG. 8 is an explanatory diagram showing another example of peripheral mechanism of the ink-jet head manufactured through the manufacturing process of FIG. 3 or FIG. 5.
Figure 9:
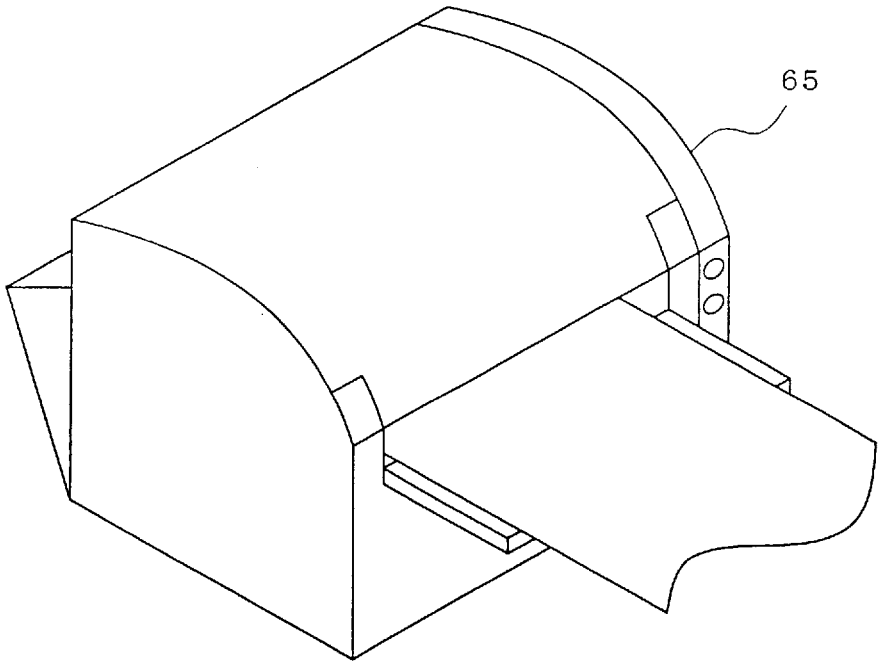
FIG. 9 is an outline view of an ink-jet recording apparatus (line printer) in which the mechanism in FIG. 8 is incorporated.

FIG. 8 is an explanatory diagram showing another example of a peripheral mechanism of an ink-jet head manufactured through the manufacturing process in any one of Embodiments 1 to 3. In this Embodiment 5, an ink-jet head 60 for a line printer is constituted. Since a glass substrate is used for a substrate so that necessary constituent parts can be piled up thereon as described above, it is possible to manufacture a line printer ink-jet head having a multi-nozzle arrangement with 1,000 nozzles or more if a large-sized glass substrate is used. In FIG. 8, data lines 61 and ink pipes 62 are led to the ink-jet head 60. Rollers 63 are disposed on front and rear sides of the ink-jet head 60. By the ink-jet head 60, one-line's printing is performed simultaneously on paper 54 fed out by the rollers 53. This mechanism of FIG. 8 is incorporated in an ink-jet recording apparatus 65 shown in FIG. 9.

What is claimed is:

1. A recording apparatus comprising:

an ink jet head, wherein said ink jet head comprises (a) a first substrate having a plurality of nozzle holes, and (b) a second substrate comprising a glass substrate, said glass substrate including on its surface:

(i) a plurality of individual electrodes corresponding to the nozzle holes, (ii) an insulating film covering the individual electrodes, (iii) a plurality of diaphragms comprising a silicon nitride film, each said diaphragms disposed to respectively face an individual electrode with the insulating film and an air gap therebetween, and (iv) a plurality of ejection chambers, each said chamber communicating with a respective said nozzle hole, each said ejection chamber respectively formed on a diaphragm and below the first substrate.

* * * * *